United States Patent [19]

Mueller et al.

[11] Patent Number: 4,604,046

[45] Date of Patent: Aug. 5, 1986

[54] DIRECT IGNITION GAS BURNER CONTROL SYSTEM

[76] Inventors: Carl J. Mueller, 7063 Stinger Pl., St. Louis, Mo. 63129; Bernard T. Brown, 4601 Skyridge Dr., St. Louis, Mo. 63128; Dennis M. Rippelmeyer, 217 Koenigsmark, Waterloo, Ill. 62298; John S. Haefner, P.O. Box 221, Hillsboro, Mo. 63050

[21] Appl. No.: 571,336

[22] Filed: Jan. 16, 1984

Related U.S. Application Data

[62] Division of Ser. No. 296,818, Aug. 27, 1981, Pat. No. 4,444,551.

[51] Int. Cl.[4] ..... F23N 5/00

[52] U.S. Cl. ..... 431/2; 431/16; 431/66; 431/69

[58] Field of Search ..... 431/2, 14, 16, 18, 22, 431/66, 69, 71, 72, 73, 74

[56] References Cited

U.S. PATENT DOCUMENTS

| | | | |
|---|---|---|---|
| 3,744,954 | 7/1973 | Faulkner | 431/16 |
| 3,807,933 | 4/1974 | Fernstrom | 431/66 |
| 3,902,839 | 9/1975 | Matthews | 431/46 |
| 3,914,092 | 10/1975 | Matthews | 431/66 |
| 3,955,910 | 5/1976 | Matthews | 431/25 |
| 4,047,878 | 9/1977 | Matthews | 431/22 |
| 4,131,412 | 12/1978 | Matthews | 431/16 |
| 4,161,387 | 7/1979 | Courier de Mere | 431/74 |
| 4,188,181 | 2/1980 | Rippelmeyer et al. | 431/66 |
| 4,211,526 | 7/1980 | Schilling | 431/66 X |
| 4,245,977 | 1/1981 | Morese | 431/6 |
| 4,265,612 | 5/1981 | Romanelli et al. | 431/66 |
| 4,289,476 | 9/1981 | Vises et al. | 431/66 |
| 4,298,335 | 11/1981 | Riordan et al. | 431/25 |
| 4,306,853 | 12/1981 | Rippelmeyer | 431/66 |
| 4,323,342 | 4/1982 | Sommers et al. | 431/66 |
| 4,402,663 | 9/1983 | Romanelli et al. | 431/66 |

*Primary Examiner*—Margaret A. Focarino

[57] ABSTRACT

A direct ignition gas burner control system includes a microcomputer for controlling energizing of an electrical resistance igniter, for subsequently effecting flow of gas to the burner when the igniter is at gas ignition temperature, and for effecting continued flow of gas in response to current flow through the burner flame.

4 Claims, 5 Drawing Figures

A1
A2
+5V
RESET
INT
EA
XTAL1
XTAL2
T0
T1
VCC
VSS
VDD
VREF
EDC
DL
SI
SCK
SO
CS
CL0
CL1
P20
P21
P22
P23
P10
P11
P12
P13
P14
P15
P16
P17
P24
P25
P26
P27
D0
D1
D2
D3
D4
D5
D6
D7
A0
A1
A2
A3
A4
A5
A6
A7

DIRECT IGNITION GAS BURNER CONTROL SYSTEM

This application is a division of application Ser. No. 296,818 filed Aug. 27, 1981, now U.S. Pat. No. 4,444,551.

BACKGROUND OF THE INVENTION

This invention rlates to electrically operated control systems for controlling operation of a main gas burner wherein the burner is directly ignited.

Due to the ever increasing need for conservation of energy, direct ignition gas burner control systems and other systems which eliminate the conventional standing-pilot are becoming more widely used, either voluntarily or in compliance with energy-conservation legislation. Regarding direct ignition systems, the prior art discloses various systems which appear to provide the required functions. However, they are generally either too dependent on circuit components being within very close tolerances and remaining therein after continued use, or they are quite complex and costly.

The advancements in microcomputer technology have made it economically attractive to construct a direct ignition gas burner control system utilizing a microcomputer. The microcomputer and related circuitry not only enable a considerable cost savings in providing system functions heretofore provided by discreet electrical and mechanical components, but also enable a versatility not found in prior systems.

SUMMARY OF THE INVENTION

It is, therefore, a primary object of this invention to provide a generally new and improved direct ignition gas burner control system utilizing a microcomputer.

In accordance with the present invention, a direct ignition gas burner control system comprises a low-voltage electrical resistance igniter, two serially-arranged gas valves for controlling the flow of gas to the burner, and a microcomputer and related A/D converter for controlling energization of the igniter and valves. The preferred embodiment of this invention comprises circuit means connected in parallel with the igniter and having a voltage tap that is connected to the microcomputer through the A/D converter. Signals received from this tap enable the microcomputer to determine the integrity of the igniter, to determine whether the voltage across the igniter is sufficient to enable it to attain gas ignition temperature, and to modulate energization of the igniter so as to prevent unnecessary heating thereof.

The preferred embodiment further comprises circuit means, including the microcomputer, for controlling energization of the valve windings so as to enable gas flow when the igniter is at gas ignition temperature. The system also includes flame detecting circuit means having a voltage tap connected to the microcomputer through the A/D converter. Signals received from this tap enable the microcomputer to determine whether the flame is established. The arrangement of the system is such that the flame detecting circuit means is effective to indicate the existence of flame when the proper amount of current flows between the igniter and the burner.

The preferred embodiment further includes various circuit means for ensuring safe system operation in the event of a circuit component failure. For example, two independent circuit means are provided for controlling one of the serially-arranged valves. The arrangement is such that both circuits must be functional to effect opening the one valve and maintaining it open.

The employment of the microcomputer in the system of the present invention provides various desirable features. For example, the microcomputer enables the capturing and comparing of existing circuit values so as to negate the effect of degregation of such circuit values due to age or ambient conditions. Further, the microcomputer is programmed to provide exact time periods for particular functions; to provide a determination of whether one or both of the gas valves leak; to provide for visual indication of specific system malfunctions; and to provide a lock-out condition so as to prevent unsafe operation of the system.

The above-mentioned and other objects and features of the present invention will become apparent from the following description when read in conjunction with the accompanying drawings.

DESCRIPTION OF THE PREFERRED EMBODIMENT

Figure 1:
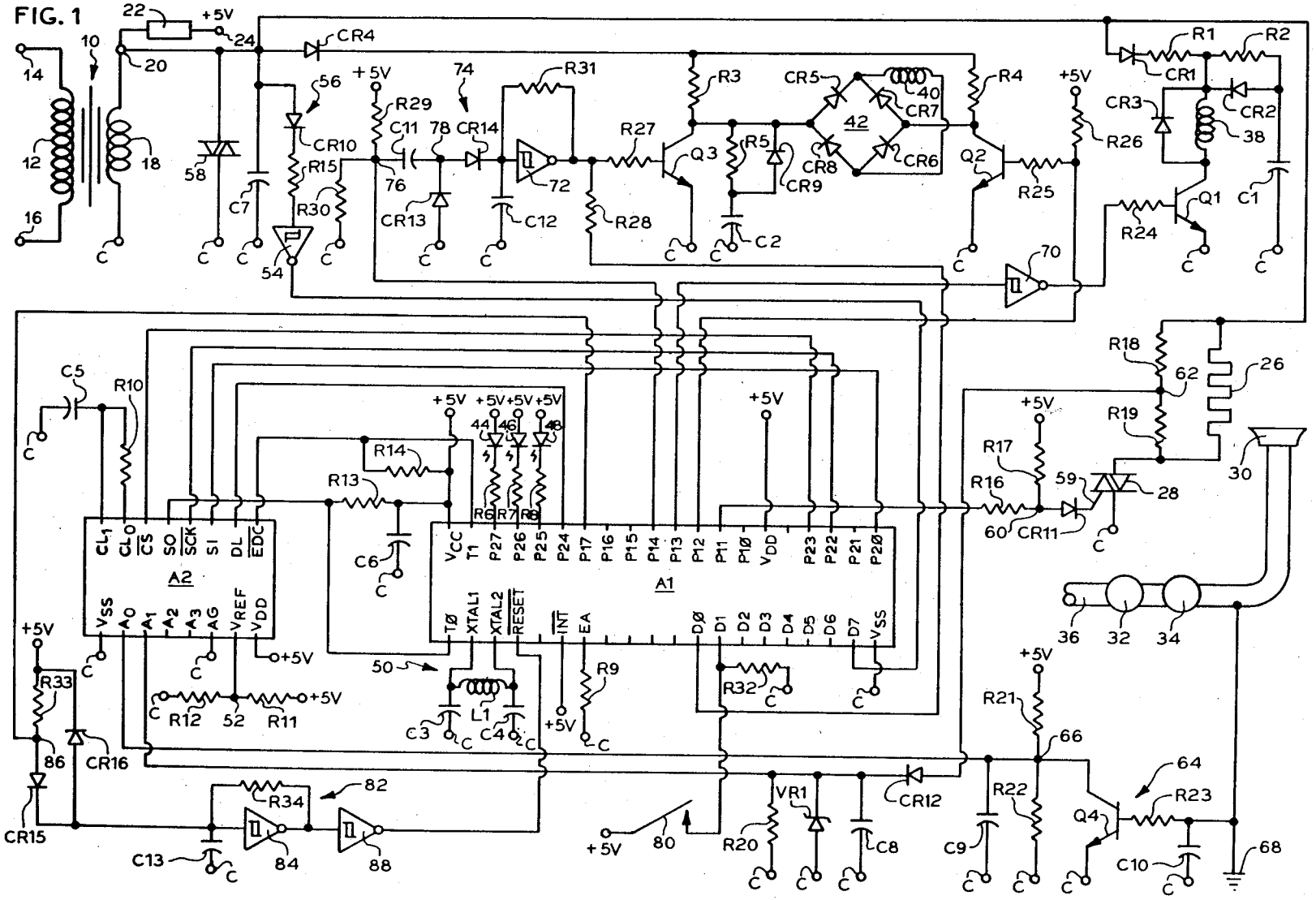
FIG. 1 is a diagrammatic illustration of a burner control system constructed in accordance with the present invention.

Referring now to the drawings, the control system of FIG. 1 includes a voltage step-down transformer 10 having a primary winding 12 connected to terminals 14 and 16 of a conventional 120 volt alternating current power source. One end of the secondary winding 18 of transformer 10 is connected to chassis common C which is isolated from earth ground. The other end of secondary winding 18 is connected to a terminal 20 so as to provide a 24 volt alternating current power source between terminal 20 and common C, and through a commercially-available 5 volt regulated power supply 22 to a terminal 24 so as to provide a +5 volt unidirectional power source between terminal 24 and common C.

Series connected across terminal 20 and common C are an electrical resistance igniter 26 and a triac 28. Igniter 26, which is preferrably a negative temperature coefficient silicon-carbide igniter, is positioned adjacent a main burner 30 and is effective, when sufficiently heated, to ignite the gas emitted from burner 30.

The flow of gas to burner 30 is controlled by two valves 32 and 34 connected fluidically in series in a gas conduit 36 leading from a gas source (not shown) to burner 30. Valve 32, hereinafter sometimes referred to as the redundant valve, is controlled by an electrical winding 38. Valve 34, hereinafter sometimes referred to as the main valve, is controlled by an electrical winding 40. Regardless of nomenclature applied to valves 32 and 34, it is to be understood that both valves must be open to enable gas to flow to burner 30, and that the closure of either valve will terminate gas flow to burner 30. It is also to be understood that valves 32 and 34 can be separate devices as shown or a unitary device.

Winding 38, which controls redundant valve 32, is connected to terminal 20 through a resistor R1 and a controlled rectifier CR1, and to common C through an NPN transistor Q1. Connected in parallel with series-connected winding 38 and transistor Q1 are a series-connected resistor R2 and a capacitor C1. A controlled rectifier CR2 is connected in parallel with resistor R2, and a contrtolled rectifier CR3 is connected in parallel with valve winding 38.

Winding 38 requires a higher level of energization to effect opening of valve 32 than it does to maintain valve 32 open. This higher level of energization is provided by capacitor C1. Specifically, when transistor Q1 is off for a sufficient time period, approximately 4 seconds, capacitor C1 is charged through rectifier CR1 and resistors R1 and R2. When transistor Q1 is turned on, capacitor C1 discharges through rectifier CR2, winding 38, and transistor Q1 to effect pull-in or opening of valve 32. Thereafter, valve 32 is maintained open by a lower value of energization of winding 38 through rectifier CR1, resistor R1, and transistor Q1, assisted by the filtering action of capacitor C1 during the off cycles of rectifier CR1. The controlled rectifier CR3 reduces any inductive spikes that may be generated by winding 38 when transistor Q1 turns off.

Winding 40, which controls main valve 34, is connected to terminal 20 through a controlled rectifier CR4, a resistor R3, and a controlled rectifer CR5 of a rectifier bridge 42, and to common C through a controlled rectifier CR6 of bridge 42 and an NPN transistor Q2. Winding 40 is also connected to terminal 20 through rectifier CR4, a resistor R4, and a controlled rectifier CR7 of bridge 42, and to common C through a controlled rectifier CR8 of bridge 42 and an NPN transistor Q3. Connected in parallel with transistor Q3 are a series-connected resistor R5 and a capacitor C2. A controlled rectifier CR9 is connected in parallel with resistor R5.

As was the case with winding 38 of valve 32, winding 40 also requires a higher level of energization to effect opening of valve 34 than it does to maintain valve 34 open. This higher level of energization is provided by capacitor C2. Specifically, when both transistors Q2 and Q3 are off for a sufficient time period, approximately 4 seconds, capacitor C2 is charged. One charging path is through resistors R3 and R5, and another charging path is through resistor R4, rectifier CR7, winding 40, rectifier CR8, and resistor R5. As will be hereinafter described, transistor Q2 is turned on before transistor Q3. When transistor Q2 is turned on, capacitor C2 discharges through rectifier CR9 and CR5, winding 40, rectifier CR6, and transistor Q2 to effect opening of valve 34. Also as will be hereinafter described, subsequent to capacitor C2 effecting the opening of valve 34, transistors Q2 and Q3 alternately turn on and off in an out-of-phase manner so that when one transistor is off the other is on. During this alternate conduction of transistors Q2 and Q3, winding 40 is maintained energized at a lower level of energization than that required to effect opening of valve 34. Specifically, when transistor Q2 is on and transistor Q3 is off, winding 40 is energized through rectifer CR4, resistor R3, rectifier CR5 and CR6, and transistor Q2. Alternately, when transistor Q3 is on and transistor Q2 is off, winding 40 is energized through rectifier CR4, resistor R4, rectifiers CR7 and CR8, and transistor Q3.

Controlling the operation of valves 32 and 34 and igniter 26 is a microcomputer A1. Contained within the microcomputer A1 are an 8 bit CPU (central processing unit), a 1k×8 ROM (read only memory), a 64×8 RAM (random access read/write memory), 27 I/O (input-/output)lines, and an 8-bit timer/event counter. Interfaced with microcomputer A1 is an A/D (analog to digital) converter A2. While the microcomputer A1 and A/D converter A2 are illustrated as separate devices, it is to be understood that the two devices may be combined into a single device.

In FIG. 1, selected pins of microcomputer A1 are designated $V_{CC}$, T1, P2Ø through P27, P1Ø through P17, $V_{DD}$, TØ, XTAL1, XTAL2, $\overline{\text{RESET}}$, $\overline{\text{INT}}$, EA, DØ through D7 and $V_{SS}$. The pins of A/D converter A2 are designated $CL_1$, $CL_0$, $\overline{\text{CS}}$, SO, $\overline{\text{SCK}}$, SI, DL, $\overline{\text{EOC}}$, VSS, $A_0$, $A_1$, $A_2$, $A_3$, AG, $V_{REF}$, and $V_{DD}$. While the connections of the above designated pins with each other and with other components in FIG. 1 will now be described, a more specific explanation of the functions of such pins and connections will be described hereinafter.

Pin $V_{CC}$ of microcomputer A1 is connected to the +5 volt power supply and functions as the main power supply input for microcomputer A1. Pin $V_{DD}$ therein is also connected to the +5 volt power supply and functions as the power supply for the ROM. Also connected to the +5 volt power supply is pin $\overline{\text{INT}}$, such connection being effective to disable the active-low interrupt input.

Pin P27 of microcomputer A1 is connected through a resistor R6 and a LED 44 (light emitting diode) to the +5 volt power source, pin P26 is connected through a resistor R7 and a LED 46 to the +5 volt source, and pin P25 is connected through a resistor R8 and a LED 48 to the +5 volt source. As will be hereinafter described, one or more of LED's 44, 46, and 48 are energizable so as to provide a visual indication of specific system malfunctions that may occur.

Pin $V_{SS}$ of microcomputer A1 is connected to common C and functions as the connection of microcomputer A1 to the common C potential. Pin EA, an active-high external access input, is connected through a resistor R9 to common C so as to disable Pin EA.

An auxiliary oscillator 50 is connected to microcomputer A1 for establishing the frequency of the on-chip oscillator in microcomputer A1. The on-chip oscillator establishes the speed at which the CPU executes the program instructions. Oscillator 50 comprises a capacitor C3 connected between pin XTAL1 and common C, a capacitor C4 connected between pin XTAL2 and common C, and an inductor L1 connected across pins XTAL1 and XTAL2. The values of capacitors C3 and C4 and inductor L1 in applicants' arrangement are such that the established frequency is approximately 3.6 MHZ.

In the A/D converter A2, pin $V_{DD}$ is connected to the +5 volt power supply. Pin $V_{SS}$, the digital ground pin, is connected to common C, and pin AG, the analog ground pin, is connected to common C. Pin $CL_o$ is connected to common C through a resistor R10 and a capacitor C5. Pin $CL_1$ is connected to common C through capacitor C5.

Reference voltage input $V_{REF}$ in A/D converter A2 is connected to a junction 52 between resistors R11 and R12 which are connected in series between the +5 volt power source and common C. Resistors R11 and R12 are of equal value so as to establish a 2.5 volt reference voltage on pin $V_{REF}$.

The interfacing of A/D converter A2 and microcomputer A1 includes the connections of pin $\overline{\text{CS}}$ to pin P23, pin SO to pin TØ and through a resistor R13 to pin $V_{CC}$, pin $\overline{\text{SCK}}$ to pin P22, pin SI to pin P2Ø, pin DL to pin P24, and pin $\overline{\text{EDC}}$ to pin T1 and through a resistor R14 to pin $V_{CC}$. A capacitor C6 is connected between pin $V_{CC}$ of microcomputer A1 and common C for transient suppression.

Pin D7 of microcomputer A1 is connected to the output of a Schmitt-trigger 54 in a wave-shaper circuit indicated generally at 56. The input of Schmitt-trigger 54 is connected to terminal 20 through a resistor R15 and a controlled rectifier CR10. A varister 58, having a breakdown voltage of approximately 56 volts, and a capacitor C7 are connected in parallel with each other between terminal 20 and common C to suppress transient spikes.

The function of wave-shaper circuit 56 is to provide a real-time base for microcomputer A1. The output of wave-shaper circuit 56 is a 60 HZ square wave of logic. 0 or low and 1 or high. The software or program in microcomputer A1 provides for high frequency scanning of pin D7, such as every 500 microseconds. Each time pin D7 goes from 0 to 1 and from 1 to 0 or after a multiple of each such changes, one or more time-dedicated registers of RAM are appropriately incremented . In the program, when such a register is called, the register is cleared and then incremented every 8.3 milliseconds or some multiple thereof. The register value is compared to a specified fixed value in ROM. When the values are the same, the appropriate programmed function dependent upon this timing is executed.

Since all real-time functions are dependent upon wave-shaper circuit 56 being operable, means are provided to ensure such operability. Specifically, microcomputer A1 includes a counter therein which is incremented at the frequency determined by auxiliary oscillator 50 and which is activated by the change in logic state of wave-shaper circuit 56. If wave-shaper circuit 56 does not change its logic state within the specified counter value, the system will lock out.

Pin P11 of microcomputer A1 is connected through a resistor R16 and a controlled rectifier CR11 to the gate 59 of triac 28. A resistor R17 is connected between the +5 volt source and the connecting junction 60 of resistor R16 and rectifier CR11. When pin P11 is low, rectifier CR11 blocks and triac 28 is off. When pin P11 is high, rectifier CR11 conducts and triac 28 is biased on through resistor R17 and rectifier CR11.

Connected across igniter 26 are two series-connected resistors R18 and R19. Analog input pin A1 of A/D converter A2 is connected through a controlled rectifier CR12 to a junction 62 between resistors R18 and R19. A filtering capacitor C8 is connected between the cathode of rectifier CR12 and common C. A resistor R20 is also similarly connected to provide a discharge path for capacitor C8. A voltage regulator VR1 is also connected between the cathode of rectifier CR12 and common C to limit the voltage input to pin $A_1$ of A/D converter A2 to a value of 5 volts.

A flame-detect circuit, indicated generally at 64, is connected to analog input pin $A_o$ of A/D converter A2. Circuit 64 includes two resistors R21 and R22 of equal resistance connected in series between the +5 volt source and common C. A NPN transistor Q4 is connected in parallel with resistor R22, the collector of transistor Q4 being connected to a junction 66 between resistors R21 and R22 and the emitter thereof being connected to common C. A filter capacitor C9 is connected between junction 66 and common C. The base of transistor Q4 is connected through a resistor R23 to burner 30 which is grounded at 68. A filter capacitor C10 is connected between burner 30 and common C.

In the absence of flame conduction current, transistor Q4 is off and a voltage of 2.5 volts exists at junction 66 and thus at pin $A_o$ of A/D converter A2. When flame current exists, transistor Q4 is biased on through resistor R23, causing the voltage at junction 66 to decrease.

Pin P13 of microcomputer A1 is connected through a Schmitt-trigger 70 and a resistor R24 to the base of transistor Q1. When it is desired to prevent capacitor C1 from charging to the value necessary to effect pull-in of redundant valve 32 which is controlled by winding 38, or when it is desired to close valve 32, microcomputer A1 provides a repetitive high and low signal at pin P13 of 100 milliseconds high and 100 milliseconds low. When pin P13 is high, the input of the Schmitt-trigger 70 is high so that the output thereof is low, biasing transistor Q1 off. When pin P13 is low, the output of the Schmitt-trigger 70 is high so that transistor Q1 is biased on. Since capacitor C1 can only charge when transistor Q1 is off and it requires approximately 4 seconds to charge capacitor C1 to the pull-in voltage of winding 38, valve 32 remains closed as long as this condition exists. When it is desired to energize winding 38, pin P13 of microcomputer A1 is maintained high for approximately 4 seconds, biasing transistor Q1 off and thus allowing capacitor C1 to charge sufficiently. Thereafter, pin P13 is low, biasing transistor Q1 on. When it is desired to de-energize winding 38, the repetitive high-low pulse again exists. The first 100-millisecond high portion provides sufficient off time of transistor Q1 to ensure de-energizing of winding 38.

When it is desired to prevent energizing of winding 40, which controls main valve 34, transistors Q2 and Q3 are cyclically biased on and off. Regarding transistor Q2, the base of transistor Q2 is connected through a resistor R25 to pin P12 of microcomputer A1, and through resistor R25 and a resistor R26 to the +5 volt source. When it is desired to prevent energizing of winding 40, microcomputer A1 provides a repetitive high and low signal at pin P12 of 100 milliseconds high and 100 milliseconds low. When pin P12 is high, transistor Q2 is biased on by the +5 volt source through resistors R25 and R26. When pin P12 is low, transistor Q2 is biased off. Under this condition, transistor Q2 prevents capacitor C2 from charging to the pull-in voltage of winding 40, regardless of the conductive state of transistor Q3. Specifically, if transistor Q3 were biased off, capacitor C2 could charge through resistor R5 only when transistor Q2 is off. When transistor Q2 is on, resistor R5 and capacitor C2 are shunted by the lower impedance path through winding 40 and transistor Q2. Under this condition, capacitor C2 would be prevented from charging to the pull-in voltage of winding 40 since it requires approximately 4 seconds for capacitor C2 to charge to the required pull-in value. If transistor Q3 were biased on, capacitor C2 could not charge since series-connected capacitor C2 and resistor R5 are in parallel with transistor Q3.

Regarding transistor Q3, the base of transistor Q3 is connected through a resistor R27 to the output of a Schmitt-trigger 72, and through resistor R27 and a resistor R28 to pin DØ of microcomputer A1. Schmitt-trigger 72 comprises a portion of an oscillator circuit indicated generally at 74.

In oscillator circuit 74, a resistor R29 and a resistor R30 are connected in series between the +5 volt power source and common C. One end of a capacitor C11 is connected to a junction 76 between resistors R29 and R30, and the other end of capacitor C11 is connected through a controlled rectifier CR13 to common C. Another controlled rectifier CR14 is connected between the connecting junction 78 of capacitor C11 and rectifier CR13 and the input of Schmitt-trigger 72. A capacitor C12 is connected between the input of Schmitt-trigger 72 and common C. A resistor R31 is connected between the input and the output of Schmitt-trigger 72.

Pin P14 of microcomputer A1 is connected to junction 76 in oscillator cirucit 74. When it is desired to prevent capacitor C2 from charging to the value necessary to effect pull-in of main valve 34 which is controlled by winding 40, microcomputer A1 maintains a constant high at pin P14. When pin P14 is maintained high, junction 76 remains high. Under this condition, capacitor C12 cyclically charges and discharges through resistor R31, causing the output of Schmitt-trigger 72 to be alternately high and low. The parameters of the components in circuit 74 are of such values that the frequency of oscillation is approximately 3 HZ. Since the base of transistor Q3 is connected to the output of Schmitt-trigger 72 through resistor R27, transistor Q3 is biased on and off at this frequency of 3 HZ. Under this condition, capacitor C2 is prevented from charging to the pull-in voltage of winding 40 since it requires that transistor Q3 be off for approximately 4 seconds to enable capacitor C2 to charge to such pull-in voltage value. If the constant high at junction 76 does not result in oscillation of oscillator circuit 74, the system will lock out.

When it is desired to energize winding 40, a high frequency signal is provided at pin P14 of microcomputer A1 and thus at junction 76 in oscillator circuit 74. When this signal at junction 76 goes high, capacitors C11 and C12 charge. When the signal goes low, capacitor C11 discharges through pin P14 and rectifier CR13. Capacitor C12, due to rectifier CR14 and the high impedance of resistor R31, maintains its charge. With capacitor C12 charged, the input of Schmitt-trigger 72 remains high and thus the output thereof remains low. With the output of Schmitt-trigger 72 low, the base of transistor Q3 is low, biasing transistor Q3 off. Also when it is desired to energize winding 40, microcomputer A1 provides a constant low at pin P12 so that transistor Q2 is biased off. With both transistors Q2 and Q3 biased off, capacitor C2 can charge.

After capacitor C2 has charged for 4 seconds, pin P12 of microcomputer A1 goes high, biasing transistor Q2 on. With transistor Q2 on, capacitor C2 discharges through valve winding 40, causing main valve 34 to open. The high frequency signal is then terminated at pin P14 of microcomputer A1 and a constant high appears thereat, thus allowing oscillator circuit 74 to again provide the cyclical high-low on the output of Schmitt-trigger 72.

The appearance of a high at the output of Schmitt-trigger 72 causes transistor Q3 to turn on. Pin DØ of microcomputer A1, being connected through resistor R28 to the output of Schmitt-trigger 72, detects the change from low to high and causes pin P12 of microcomputer A1 to go low. With pin P12 low, transistor Q2 is biased off. With transistor Q3 on and transistor Q2 off, winding 38 remains energized through transistor Q3. When the output of Schmitt-trigger 72 subsequently goes low, transistor Q3 is biased off and pin DØ detects the change from high to low and causes pin P12 to go high. With pin P12 high, transistor Q2 is biased on. With transistor Q3 off and transistor Q2 on, winding 38 remains energized through transistor Q2. This alternate, out-of phase, on-off operation of transistors Q2 and Q3 continues, maintaining valve winding 40 energize.

The above described circuit arrangement for controlling valve winding 40 provides a unique safety feature in that a failure of either the microcomputer A1 or the oscillator circuit 74 will result in valve winding 40 either never being energized or in being de-energized after initial energization. Specifically, when attempting to charge capacitor C2, if microcomputer A1 fails to effect the turning off of transistor Q2, capacitor C2 cannot charge. If microcomputer A1 fails to provide a high frequency signal to stop the oscillations of oscillator circuit 74, transistor Q3 would continue to be cycled on and off thus preventing charging of capacitor C2. If oscillator circuit 74 fails and continues to oscillate when the high frequency signal appears at junction 76 therein, transistor Q3 would continue to be cycled on and off thus preventing charging of capacitor C2.

If after winding 40 is pulled in, the microcomputer A1 fails to effect alternate on-off operation of transistors Q2 and Q3, valve winding 40 would either be shunted by transistors Q2 and Q3 when both are on or would be disconnected from power source terminal 20 by transistors Q2 and Q3 when both are off, either of which condition would effect de-energizing of winding 40. If oscillator circuit 74 fails and does not oscillate when the constant high reappears at junction 76 therein, microcomputer A1 would detect no change of state at the output of Schmitt-trigger 72 whereby transistor Q2 would not change conduction states as required to keep winding 40 energized.

The above described circuit arrangement provides an additional safety feature in that a failure of microcomputer A1 would only permit one of the valves 32 and 34 to open or remain open. Specifically, transistor Q1, which controls winding 38 of redundant valve 32, and transistor Q2, which controls winding 40 of main valve 34, are controlled by opposite logic signals from microcomputer A1. Because of Schmitt-trigger 70, transistor Q1 is biased on when the signal at pin P13 of microcomputer A1 is low and is biased off when the signal at pin P13 is high, whereas transistor Q2 is biased on when the signal at pin P12 of microcomputer is high and is biased off when the signal at pin P12 is low.

A conventional space thermostat 80 is connected between the +5 volt power source and pin D1 of microcomputer A1. A resistor R32 is connected between pin D1 and common C.

Connected to pins $\overline{\text{RESET}}$ and P17 of microcomputer A1 is a reset circuit indicated generally at 82. In reset circuit 82, a resistor R33 and a controlled rectifier CR15 are connected in series between the +5 volt power source and the input of a Schmitt-trigger 84. Pin P17 of microcomputer A1 is connected to a junction 86 between resistor R33 and rectifier CR15. A controlled rectifier CR16 is connected across the series-connected resistor R33 and rectifier CR15 in opposed polarity to rectifier CR15. A capacitor C13 is connected between the input of Schmitt-trigger 84 and common C. A resistor R34 is connected between the input and output of Schmitt-trigger 84. Connected to the output of Schmitt-trigger 84 is the input of another Schmitt-trigger 88, the output of which is connected to pin $\overline{\text{RESET}}$ of microcomputer A1.

At the instant power is initially applied to terminals 14 and 16, capacitor C13 in reset circuit 82 is discharged so that the input of Schmitt-trigger 84 is low. This condition provides a high on the input of Schmitt-trigger 88 and thus a low on pin $\overline{\text{RESET}}$ of microcomputer A1. With a low on pin $\overline{\text{RESET}}$, the microcomputer A1 is initialized so that, among other effects, the program counter is reset and all I/O ports are placed in the input state. Capacitor C13 then charges, causing a high on the input of Schmitt-trigger 84, a low on the input of Schmitt-trigger 88, and thus a high on the pin $\overline{\text{RESET}}$. The time constant for charging capacitor C13 is sufficiently long to enable microcomputer A1 to perform its reset functions. A high on the pin $\overline{\text{RESET}}$ places microcomputer A1 in its run mode. Micrcomputer A1 thereafter provides a high frequency signal at pin P17 and thus at junction 86 to prevent oscillation of reset circuit 82. As long as this signal is provided, the pin $\overline{\text{RESET}}$ remains high and microcomputer A1 remains in the run mode. Should the signal at junction 86 cease to exist, for example, due to a power failure or to some transient condition, reset circuit 82 is effective to again initialize the microcomputer A1.

OPERATION

Figure 2:
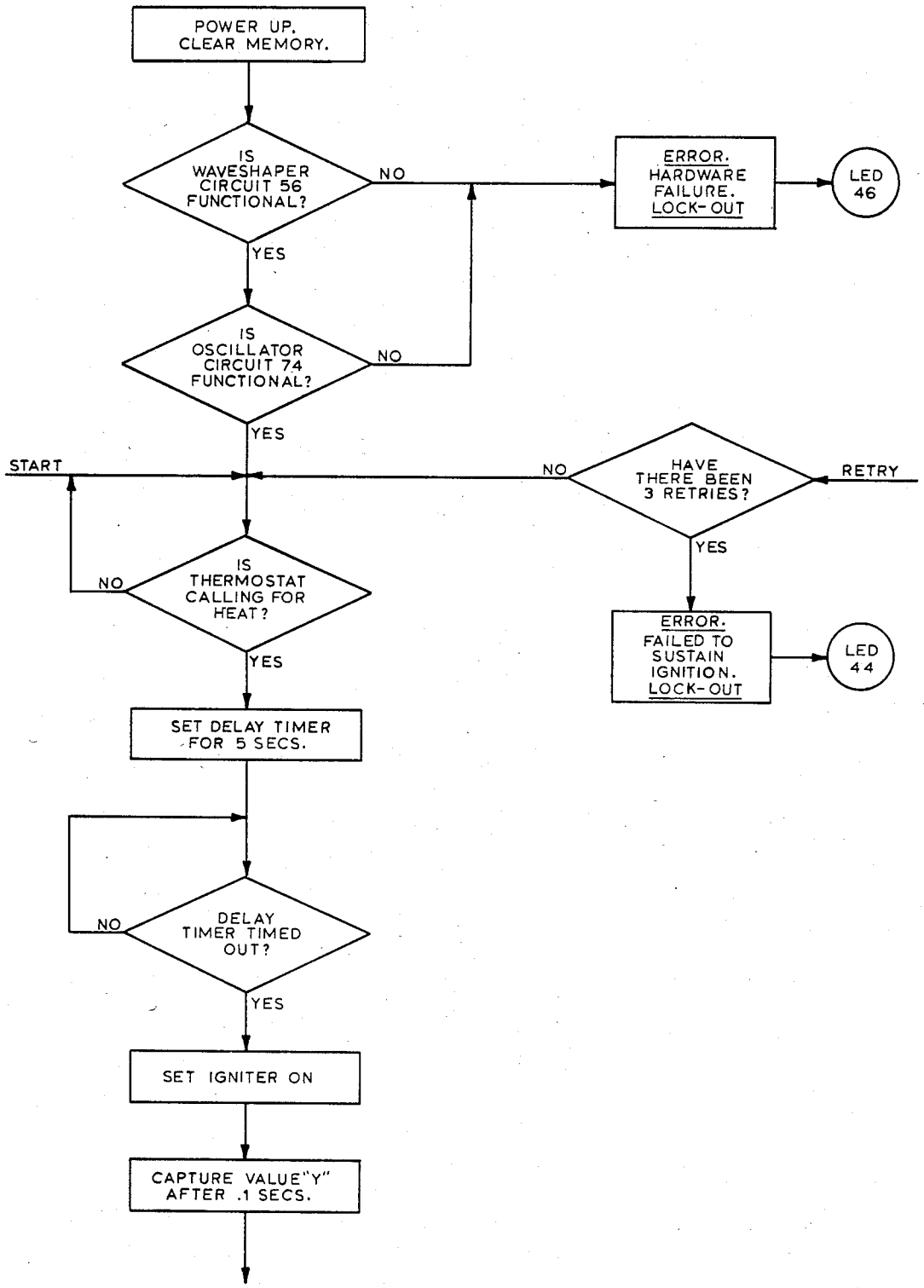
FIGS. 2, 3, 4, and 5, when combined, is a flow chart depicting the logic sequence programmed into and executed by the microcomputer of the system of FIG. 1.

Referring now to FIG. 2, when electrical power is applied to the system, operation thereof is initialized by commands of power up and clear memory. Upon these commands, the reset circuit 82 is effective to zero the program counter in microcomputer A1. Also cleared to zero are all time-dedicated registers or counters in RAM, an Igniter Defect bit, a Valve Sequence bit, and a Retry counter. Pin P11 of microcomputer A1 is low so that triac 28, controlling the energizing of igniter 26, is off. Also, pin P13 of microcomputer A1 provides a repetitive high and low signal to prevent charging capacitor C1, thus preventing energizing of redundant valve winding 38. Also, pin P12 of microcomputer A1 provides a repetitive high and low signal and pin P14 thereof maintains a constant high whereby capacitor C2, which controls the initial energizing of main valve winding 40, is prevented from charging.

Microcomputer A1 constantly monitors wave-shaper circuit 56. As previously described, a counter in microcomputer A1 is incremented at the fequency determined by auxiliary oscillator 50, and the counter is activated by the change in logic state of wave-shaper circuit 56. If wave-shaper circuit 56 does not change its logic state within the specified counter value, pin P26 goes low, causing LED 46 to be energized. The system is then in lock-out. An appropriate indicia, not shown, indicates that the energization of LED 46 is evidence of a hardware failure.

Also, if the constant high appearing at pin P14 does not result in oscillation of oscillator circuit 74 as detected at pin DØ, pin P26 goes low, causing LED 46 to be energized. The system is again in lock-out.

When the system is in lock-out due to the above described hardware failures, all outputs of microcomputer A1, except for LED 46, are off. The system remains in this lock-out condition as long as electrical power exists at terminals 14 and 16, thus negating any further functioning of the system regardless of the requirements of thermostat 80.

On a call for heat, thermostat 80 closes its contacts, causing a high on pin D1 of microcomputer A1. This high causes a decrementing of a counter in microcomputer A1. Microcomputer A1 constantly monitors pin D1 to determine if thermostat 80 is calling for heat. To preclude the effect of possible thermostat contact bounce, microcomputer A1 makes no decision until a new logic state on pin D1 exists for a time greater than 100 milliseconds When the counter reaches zero, the time-dedicated registers or counters in RAM are set to provide a 5-second delay timer function. In the illustrated system, this 5-second time period is provided primarily to ensure ample cool-down time for igniter 26 in the event that previous attempts at ignition have been unsuccessfully made. In other systems, this time period can also be utilized to purge the system of any unburned gas that may have accumulated.

After the delay timer is timed out, a high appears at pin P11 of microcomputer A1. This high enables triac 28 to be gated on through resistor R17 and rectifier CR11.

Prior to triac 28 being gated on, capacitor C8 is fully charged through resistor R18 and rectifier CR12, the charge on capacitor C8 being limited to 5 volts by regulator VR1. Stored in ROM of microcomputer A1 is a digital value, referred to herein as value "X", representative of the A/D converter A2 reference voltage of 2.5 volts.

As previously described, the output of wave-shaper circuit 56 is a 60 HZ square wave. Microcomputer A1 counts these square waves pulses, and when the count reaches 6 counts, which requires approximately 100 milliseconds, pin P22 of microcomputer A1 puts out a clock signal to pin $\overline{\text{SCK}}$ of A/D converter A2. Also, pin P2Ø of microcomputer A1 puts out a channel selector signal to pin SI of A/D converter A2, which signal enables pin $A_1$ of A/D converter A2.

Pin $A_1$ of A/D converter A2 is connected to junction 62 between resistors R18 and R19 and receives an analog signal representative of the voltage at junction 62. Pin SO of A/D converter A2 sends a digital signal representative of this analog signal to pin TØ microcomputer A1. This digital signal, referred to herein as value "Y", is stored in RAM in the microcomputer A1.

Figure 3:
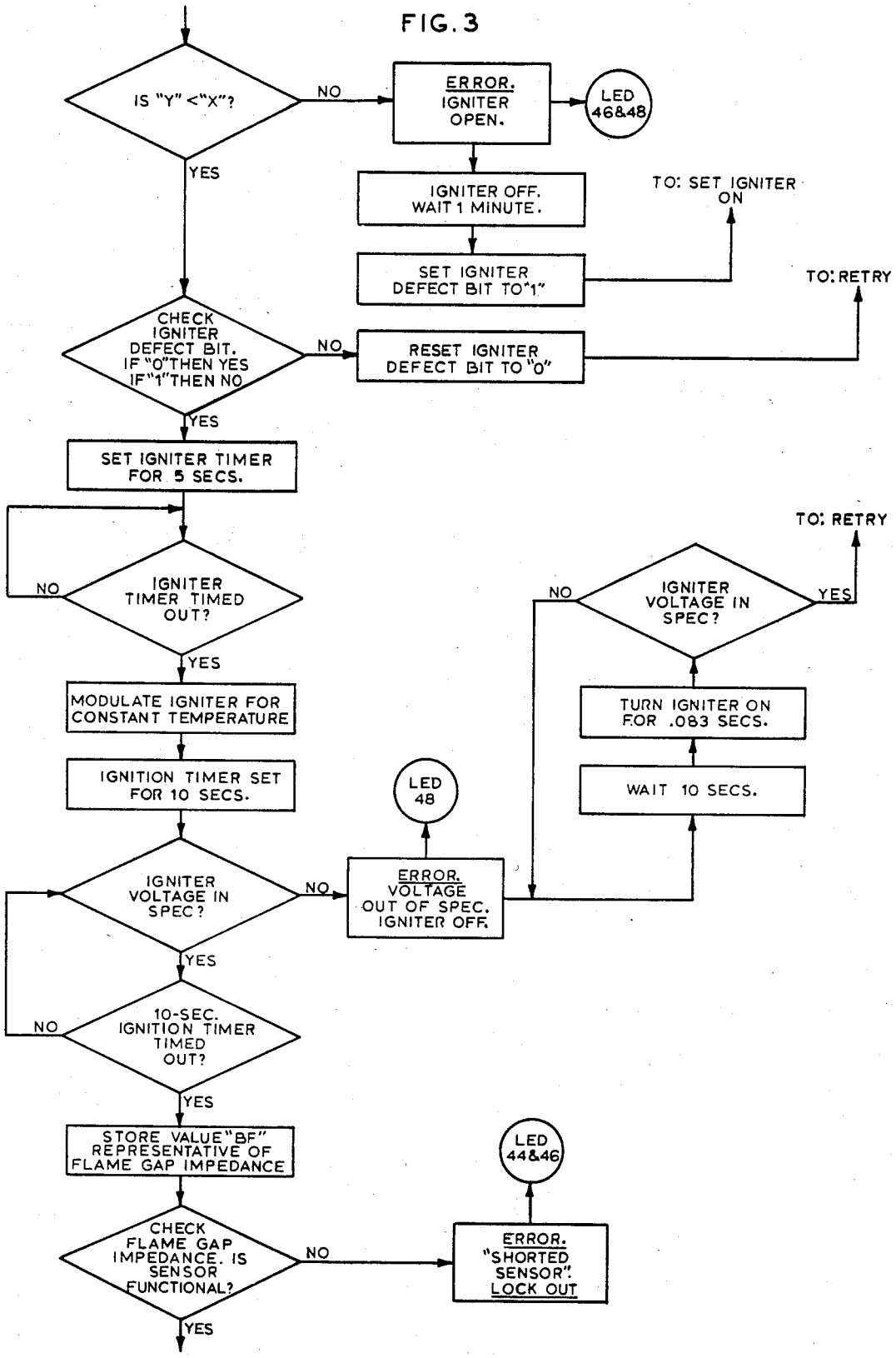

Referring to FIG. 3, microcomputer A1 compares values "X" and "Y" to determine the integrity of the igniter. Specifically, if igniter 26 is not open-circuited, the voltage at junction 62, determined by the resistance ratio of resistors R18 and R19, decreases rapidly when triac 28 is gated on, allowing capacitor C8 to discharge through resistor R20 causing the value "Y" to be less than value "X". If igniter 26 is open-circuited, the voltage at junction 62, for reasons not fully understood, decreases at a much slower rate so that, at the above described 100-millisecond check, value "Y" will not be less than value "X".

If value "Y" is not less than value "X", an indication of igniter 26 being open-circuited, pins P25 and P26 go low, causing LED's 48 and 46 to be energized. An appropriate indicia, not shown, indicates that the energization of LED's 48 and 46 is evidence of an open igniter. In addition to effecting energizing of LED's 48 and 46, microcomputer A1 provides a low at pin P11 so as to effect deenergizing of igniter 26. An appropriate counter in microcomputer A1 keeps pin P11 low for 1 minute. Also, an Igniter Defect bit is set. If this was the first occurrence of "Y" not being less than "X", the Defect bit is set from logic 0 to 1, and a new cycle of capturing, storing and comparing of value "Y" is initiated.

If the value "Y" is less than "X", microcomputer A1 checks the Igniter Defect bit. If the Defect bit is logic 1, indicating that a previous comparison showed the value "Y" was not less than "X", the Defect bit is reset to logic 0 and the program returns to RETRY. Also, LED's 48 and 46 are de-energized. As shown in FIG. 2, if there have been less than 3 retries, a new thermostat-controlled cycle is automatically initiated. If there have been 3 retries, microcomputer A1 provides a low at pin P27, causing LED 44 to be energized. The system is then in lock-out. A suitable indicia, not shown, indicates that the energization of LED 44 is evidence of a failure to sustain ignition. This lock-out condition can be removed by opening and closing the contacts of thermostat 80 which causes the system program to revert back to START.

It is noted that a reason for the above described program loop wherein the igniter 26 is turned off for 1 minute and then re-energized, is to determine whether the value "Y" not being less then "X" is due to an open igniter or due to a transient condition of some type. Specifically, if "Y" not being less than "X" is due to an open igniter, the loop continues and LED's 48 and 46 indicate the reason for system malfunction; if "Y" not being less than "X" is due to a transient condition, a new attempt at ignition can be automatically initiated when the abnormal transient condition no longer exists.

Referring again to FIG. 3, when the Igniter Defect bit is logic 0, the appropriate time-dedicated registers or counters in RAM are cleared to zero and a 5-second time period is established during which igniter 26 is energized. During this 5-second time period, pin P11 remains high so that triac 28 conducts essentially all the time whereby igniter 26 is energized during both halves of the a.c. supply.

When the above 5-second time period expires, the program progresse to the function of energizing igniter 26 in a modulating manner so as to obtain a constant temperature, the constant temperature being sufficiently high to ignite gas. At the command to modulate the igniter 26, a counter in microcomputer A1 is cleared and set for 10 seconds.

When this 10-second time period is initiated, pin P11 of microcomputer A1 goes high so as to turn on triac 28. The triac 28 is turned on at zero cross-over of the a.c. source sine wave appearing thereat and enables igniter 26 and resistors R18 and R19 to be energized. After 83 milliseconds into the 10-second time period, microcomputer A1 causes pin $A_1$ of A/D converter A2 to receive an analog signal representing measured voltage at junction 62 between resistors R18 and R19. The digital signal representative of this voltage value is transmitted from pin SO of A/D converter A2 to pin TØ of microcomputer A1. Since the values of resistors R18 and R19 are known, the voltage at unction 62 therebetween is of known proportion to the voltage across igniter 26.

Stored in ROM of microcomputer A1 is a digital value representative of the minimum voltage value required at junction 62 to ensure that igniter 26 will be heated sufficiently to ignite gas. Also stored in ROM is a digital value representative of a maximum voltage value allowed at junction 62 beyond which would indicate a system malfunction. Also stored in ROM is a digital value representative of the calculated effect, in terms of voltage, of heating the igniter 26 for one cycle of the 60 HZ power source, one cycle being of 16.6 milliseconds duration After 83 milliseconds into the 10-second time period, the above stored value representative of the effect of one cycle is substracted from the value representative of the measured voltage at junction 62. The number of substractions required to reach the above stored value representative of the minimum voltage value determines during how many, if any, of the 16.6-millisecond cycles, in a subsequent 83-millisecond time period, triac 28 is to be turned off. Specifically, during this subsequent 83-millisecond time period, triac 28 may be biased off all the time, biased on all the time, or biased off just part of the time.

Thus, when the 10-second time period is initiated, igniter 26 is energized for 83 milliseconds and the voltage at junction 62 is measured. A comparison of this measured value with a stored minimum value determines during how much, if any, of a subsequent 83-millisecond time period the igniter 26 will be energized. Thereafter, the procedure is repeated. That is, after the 83-millisecond time period during which igniter 26 may be de-energized all or part of the time, the igniter 26 is again fully energized for 83 milliseconds, the voltage is again checked and compared, and, as determined by this comparison, the igniter 26 is modulated during the subsequent 83-millisecond time period.

Referring again to FIG. 3, if the value representative of measured voltage at junction 62 is too low or too high, microcomputer A1 causes pin P11 thereof to go low and effect turning off of igniter 26. Pin P25 also goes low, causing LED 48 to be energized. An appropriate indicia, not shown, indicates that the energization of LED 48 is evidence of a low or high voltage condition at igniter 26. Microcomputer A1 is programmed to keep pin P11 low for 10 seconds to allow sufficient time for igniter 26 to cool. After 10 seconds, the igniter 26 is again energized, for 83 milliseconds, and the voltage at junction 62 is again checked and compared with the stored value in the manner previously described. If the low or high voltage condition no longer appears, the system reverts back to RETRY and LED 48 is de-energized. If the low or high voltage condition still exists, the loop continues and LED 48 indicates the reason for the system malfunction.

If the value representative of the measured voltage at junction 62 remains within the previously described high and low stored values in microcomputer A1 for the 10-second time period, the program continues to the step of storing a digital value representative of flame gap impedance. It is to be noted that microcomputer A1 effects the continued energization of igniter 26 in the modulating manner described above.

The above described method of energizing igniter 26 ensures sufficient heating thereof to attain a temperature sufficient to ignite gas and also prevents unnecessary heating which could reduce the effective life of igniter 26. Such a method thus permits the use of igniters of greater variation in resistance values and allows for considerable variation in the power source. It is to be noted, however, that microcomputer A1 can be alternatively programmed to provide constant energizing of igniter 26 instead of modulating energizing if so desired. Such constant energizing may be acceptable for an igniter whose resistance does not appreciably change after it has reached gas ignition temperature, and in a system wherein the variation in the power source are more restricted.

In the absence of a burner flame, there is no current flow through the air gap between igniter 26 and burner 30. Transistor Q4 is therefore biased off. Resistors R21 and R22 are of equal value so that the voltage at junction 66 therebetween is at a voltage value of half of the +5 volt power source. Upon the command to store value representative of flame gap impedance, pin $A_0$ of A/D converter A2 receives an analog signal representing the voltage value at junction 66. This analog signal is converted to digital and transmitted from pin SO of A/D converter to pin TØ of microcomputer A1. The value of this digital signal, referred to hereinafter as value "BF", is stored in RAM in microcomputer A1.

The value "BF" of the digital signal representative of this voltage is compared in microcomputer A1 to a value representative of the voltage that would exist at junction 66 only under conditions wherein the igniter 26 and burner 30 are in contact with each other either directly or through a foreign object, a condition referred to hereinafter as a shorted sensor. If the digital signal indicates such a shorted sensor condition, pins P26 and P27 go low, causing LED's 44 and 46 to be energized. The system is then in lock-out. An appropriate indicia, not shown, indicates that the energization of LED's 44 and 46 is evidence of the above described shorted sensor condition. If this shorted sensor condition is corrected, this lock-out condition can be removed by opening and then closing the contacts of thermostat 80, causing the system program to revert back to START. While the flow chart illustrates that this check for a shorted sensor is performed at this time in the burner cycle, it is to be noted that the program calls for this check at various other times during each burner cycle. For example, this sub-routine check is called for before igniter 26 is initially energized, and also during the time that burner flame is established.

Figure 4:
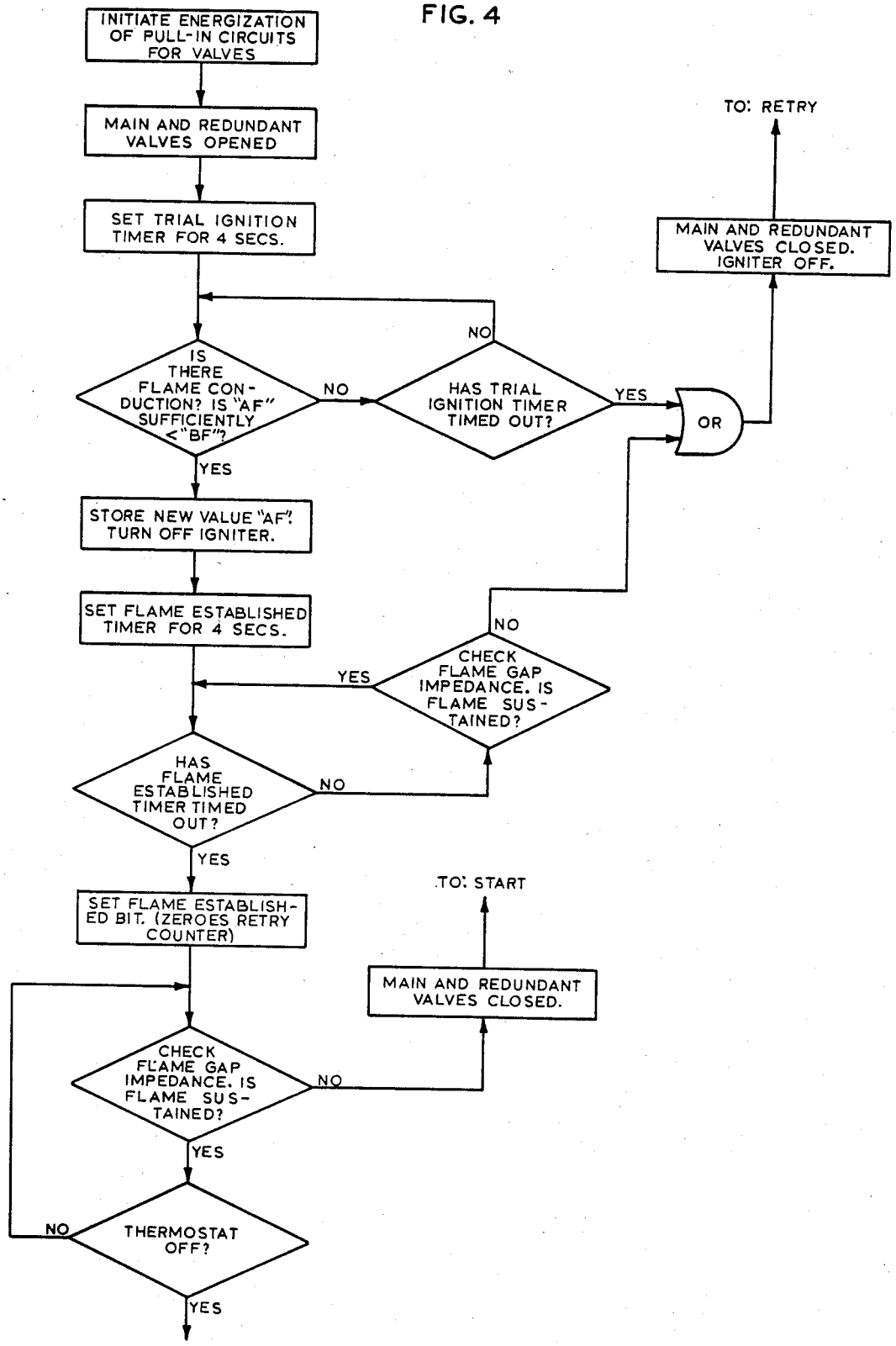

Referring to FIG. 4, microcomputer A1 then initiates energization of the pull-in circuits for valve windings 38 and 40 which control valves 32 and 34, respectively. Specifically, pin P13 of microcomputer A1 goes high to enable transistor Q1 to be off so that capacitor C1 can charge. Also, pin P12 of microcomputer A1 goes low to enable transistor Q2 to be off, and a high frequency signal is provided at pin P14 to effect termination of oscillations in oscillator circuit 74, which termination enables transistor Q3 to be biased off. With transistors Q2 and Q3 off, capacitor C2 can charge. A counter in microcomputer A1 establishes a 4-second time period to enable capacitors C1 and C2 to charge sufficiently.

At the termination of the above 4-second time period, pin P13 of microcomputer A1 goes low to enable transistor Q1 to be biased on. With transistor Q1 on, capacitor C1 discharges through rectifier CR2, valve winding 38, and transistor Q1, causing redundant valve 32 to open. Winding 38 is then held in through rectifier CR1, resistor R1, and transistor Q1. Also, pin P12 goes high to enable transistor Q2 to be biased on. With transistor Q2 on, capacitor C2 discharges through rectifiers CR9 and CR5, valve winding 40, rectifier CR6, and transistor Q2, causing main valve 34 to open. Also, the high freqency signal at pin P14 is terminated and a constant high appears thereat, allowing oscillator circuit 74 to again begin oscillating.

As soon as capacitor C12 in oscillator circuit 74 effects a high on the output of Schmitt-trigger 72, transistor Q3 is biased on. It is noted that transistor Q2 is biased on before transistor Q3 so as to prevent capacitor C2 from discharging through transistor Q3. The delay between turn-on of transistors Q2 and Q3 is due to the discharge time-constant of capacitor C12 through resistor R31.

When oscillator circuit 74 begins oscillating, pin DØ of micrcomputer A1 detects the change of logic state at the output of Schmitt-trigger 72 and effects the previously described alternate, out-of-phase, on-off operation of transistors Q2 and Q3 which enables winding 40 to be alternately held in through a first circuit comprising resistor R3, rectifier CR5, winding 40, rectifier CR6, and transistor Q2, and a second circuit comprising resistor R4, rectifier CR7, winding 40, rectifier CR8, and transistor Q3.

With valves 32 and 34 open, gas flows to burner 30. A counter in microcomputer A1 is cleared and set for a 4-second trial ignition period.

At 200 milliseconds into the 4-second trial ignition period, microcomputer A1 receives a digital signal representative of the voltage at junction 66 between resistors R21 and R22. If burner flame has been established, the flame lowers the impedance of the gap between igniter 26 and burner 30, and current flows from igniter 26, through the flame, to burner 30, through resistor R23 and the base-emitter of transistor Q4, biasing transistor Q4 on. With transistor Q4 on, the voltage at junction 66 decreases.

The value of the digital signal representative of this decreased voltage at junction 66, referred to hereinafter as value "AF", is also compared in microcomputer A1 to the previously described digital signal value "BF". If the value "AF" is less than the value "BF" by an amount representative of at least an 8-megohm change in flame gap impedance, which value of impedance change is indicative of the existence of a burner flame, the value "AF" is stored in RAM in microcomputer A1, replacing the previously stored value "BF". Also, pin P11 of microcomputer A1 is caused to go low so as to turn off triac 28 and thus de-energize igniter 26.

If the value "AF", checked at 200 milliseconds into the 4-second trial ignition period, is not sufficiently less than the value "BF", microcomputer A1 provides for continued checking of the value "AF" every 200 milliseconds for the entire 4-second period until the value "AF" finally becomes sufficiently less, indicating the presence of burner flame. As illustrated in FIG. 4, if ignition fails to occur within the 4-second trial ignition period, an OR gate is activated, causing microcomputer A1 to effect closing of valves 32 and 34, de-energizing of igniter 26, and returning of the program to RETRY.

As soon as the value "AF" is sufficiently less than the value "BF", the 4-second trial ignition period is terminated and a counter in microcomputer A1 is reset to provide a 4-second time period during which the newly established flame is monitored. During this 4-second period, microcomputer A1 receives a digital signal, every 200 milliseconds, representative of the voltage at junction 66. The first of the values of the digital signals received, referred to hereinafter as values "DF", is compared in microcomputer A1 to the stored value of previously described signal "AF". If the difference in value between the first of values "DF" and the stored "AF" is within a predetermined amount, this first value "DF" replaces the previously stored value "AF" in RAM. Thereafter, the value "DF" of each new digital signal replaces the stored value "DF" of the previous signal, as long as the difference between the stored value and the new value is within the predetermined amount. This process continues until the 4-second time period has expired.

If during the above 4-second time period, the value "DF" of one of the digital signals is greater than the value "AF" or of a previously stored "DF" by more than a predetermined amount, microcomputer A1 does not replace the previously stored value "AF" or "DF" and provides for as many as three more checks of the value "DF" of subsequent signals. If this condition exists at four consecutive 200-millisecond checks, another input of the above described OR gate is activated to effect closing of valves 32 and 34, maintaining igniter 26 de-energized, and returning of the program to RETRY.

It is to be noted that the above 4-second time period during which the newly established flame is monitored allows for the occurrence of a momentary flame-flicker or other phenomenon which momentarily increases the flame gap impedance, without causing system shutdown, and allows for automatic recycling of the system, within 0.8 seconds, in the event of a flame failure.

As soon as the above 4-second time period has expired, indicating that a flame is sustained, microcomputer A1 executes the command to set a Flame Established bit. At this command, microcomputer A1 clears the Retry counter to zero.

Subsequently, every 200 milliseconds, microcomputer A1 checks the voltage at junction 66 in the same manner as previously described, thus continuously checking whether the flame is sustained. Should the flame be prematurely extinguished for some reason, such as due to air in the gas line or a draft which blows out the flame, the valves 32 and 34 are closed and the system goes back to START.

It is noted that, because of transformer 10, common C is isolated from earth-ground 68 so that earth-grounded burner 30 is usable as a sensor. However, the above described method of flame detection is also applicable to systems wherein the burner is not used as a sensor. For example, if igniter 26 were a line voltage (120 volt) igniter instead of a low voltage (24 volt) igniter, transformer 10 would be omitted. In such a system, the igniter and triac would be connected across terminals 14 and 16, common C would be connected to terminal 16, burner 30 would be electrically disconnected from the junction between resistor R23 and capacitor C10, and a separate sensor (not shown) would be connected to that junction.

Figure 5:
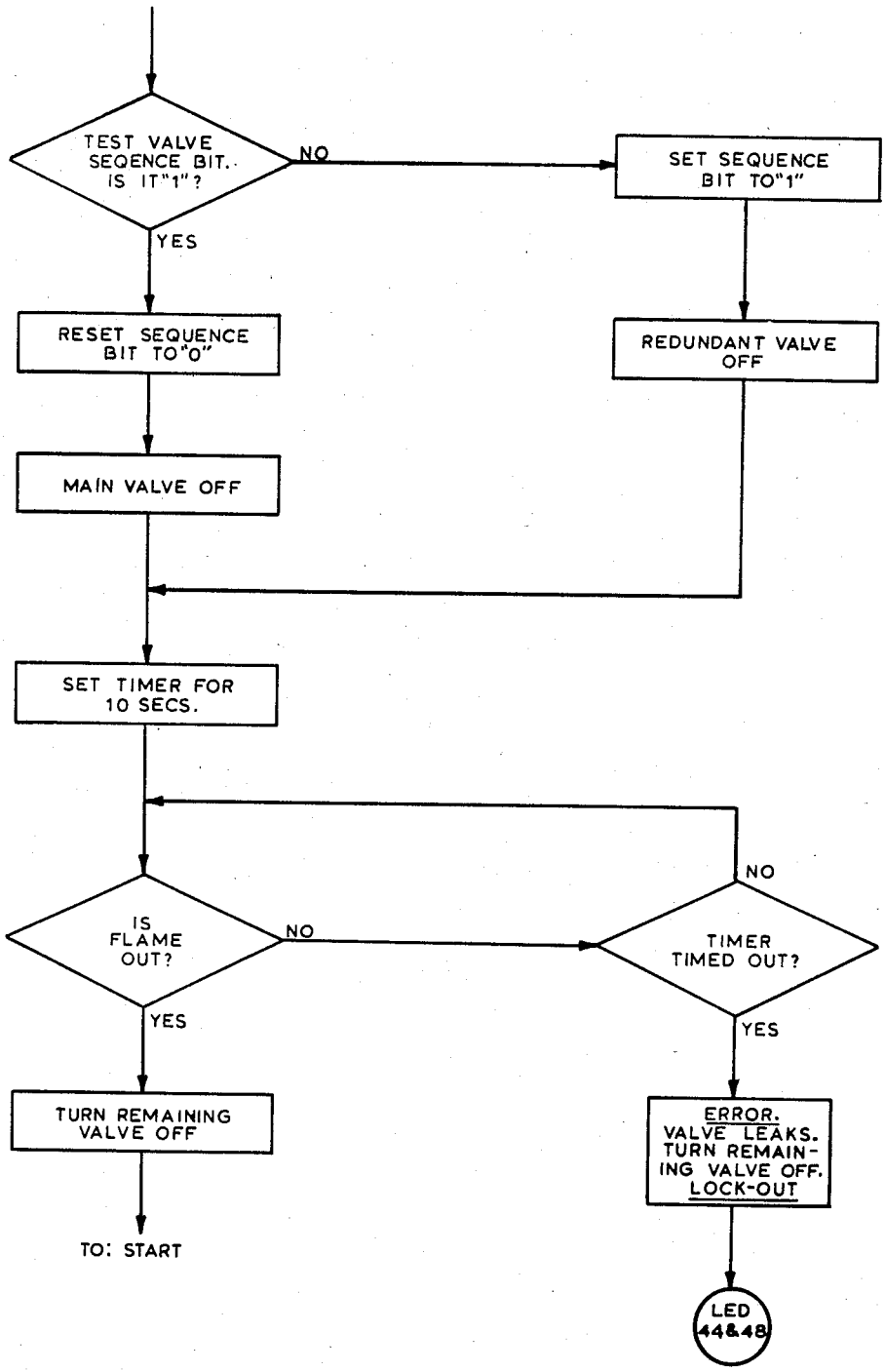

It is also noted that, while the principle of flame conduction is utilized in the preferred embodiment, the principle of flame rectification could alternatively be utilized. Both detection means are dependent upon current flow through the burner flame When thermostat 80 is satisfied, its contacts open, causing pin D1 of microcomputer A1 to go low. Microcomputer A1 then checks a Valve Sequence bit therein, such bit being either a logic 0 or 1. Referring to FIG. 5, if the bit is a logic 1, microcomputer A1 resets the bit to logic 0. Also, the previously described high and low signal appears at pin P12, causing transistor Q2 to turn off and on, and the previously described constant high appears at pin P14, causing transistor Q3 to turn off and on, so that winding 40 is de-energized and main valve 34 closes.

A counter in microcomputer A1 is then cleared to zero and reset for 10 seconds. At 200 milliseconds into this 10-second period, microcomputer A1 checks the voltage at junction 66. Since main valve winding 40 is de-energized, flame will be extinguished unless main valve 34 closes slowly or unless there is a leak past the valve seat in main valve 34 sufficient to sustain a flame. If the flame is still established at the initial 200-millisecond check, microcomputer A1 checks again at subsequent 200-millisecond intervals. When the flame is finally extinguished, transistor Q4 is biased off so that the voltage at junction 66 increases. Microcomputer A1 responds to the higher voltage, causing pin P13 therein to go high and effect the turning off of transistor Q1. With transistor Q1 off, redundant valve winding 38 is de-energized and redundant valve 32 closes. The program then returns to START in preparation for the next burner cycle.

If burner flame is not extinguished within the 10-second time period, pin P13 is microcomputer A1 goes high, effecting the de-energizing of winding 38 and thus the closing of redundant valve 32. Also, pins P25 and P27 go low, energizing LED's 48 and 44. A suitable indicia, not shown, indicates that the energization of LED's 48 and 44 is evidence that there is a gas valve leak. The system is then in lock-out.

When the system is in lock-out due to valve leakage, all outputs of microcomputer A1, except for LED's 48 and 44, are off. The system remains in this lock-out condition as long as electrical power exists at terminals 14 and 16, thus negating any further functioning of the system regardless of the requirements of thermostat 80.

As shown in FIG. 5, if the Valve Sequence bit is logic 0, the microcomputer A1 sets the bit to logic 1. Also, pin P13 goes high, effecting the turning off of transistor Q1 and thus the closing of redundant valve 32. Again, a 10-second time period, as described above, is established. When the flame is extinguished, transistors Q2 and Q3 are turned off and on as previously described, causing main valve 34 to close. If flame is not extinguished within the 10-second time period, transistor Q2 and Q3 are turned off and on, effecting the closing of main valve 34, and pins P25 and P27 go low, energizing LED's 48 and 44. The system is then in lock-out as described above.

The above described method of terminating gas flow provides means for determining whether either of valves 32 and 34 is leaking. It is noted that on one thermostat cycle redundant valve 32 is closed first, and on the next thermostat cycle main valve 34 is closed first.

The following components have been found suitable for use in the system described herein.

| COMPONENT | TYPE |
|---|---|
| A1 | 8048 (Intel Corporation) |
| A2 | PD7001 (NEC Microcomputers, Inc) |
| VR1 | IN4733 |
| CR1 through CR16 | IN914 |
| Q1 through Q4 | 2N2222 |
| Schmitt-triggers 54, 70, 72, 84, 88 | CD40014 |
| L1 | 100 Micro-henries |
| R1, R3, R4, R6, R7, R8 | 2.2k |
| R2 | 20k |
| R5 | 12k |
| R9, R17, R26, R29 | 1k |
| R10 | 51k |
| R11, R12, R34 | 100k |
| R13, R14 | 4k |
| R15, R20, R21, R22 | 1 M |
| R16 | 100 ohms |
| R18 | 200k |
| R19 | 11k |
| R23, R27, R28, R33 | 10k |
| R24 | 1.1k |
| R25, R32 | 470 ohms |
| R30 | 47k |
| R31 | 10M |
| C1, C2 | 47 Mfd. |
| C3, C4, C5, C13 | 20 Pfd. |

-continued

| COMPONENT | TYPE |
|---|---|
| C6, C8 | .1 Mfd. |
| C7 | .02 Mfd |
| C9 | .47 Mfd. |
| C10, C11, C12 | .01 Mfd |

While the invention has been illustrated and described in detail in the drawings and foregoing description, it will be recognized that many changed and modifications will occur to those skilled in the art. It is therefore intended, by the appended claims, to cover any such changes and modifications as fall withing the true spirit and scope of the invention.

We claim:

1. An improved method for operating a direct ignition gas burner control system which includes a burner, two electrically operated valves connected fluidically in series with the burner, an electrical resistance igniter, and a microcomputer, comprising the steps of:

energizing the igniter;

opening both valves so as to enable flow of gas to said burner and ignition thereof;

detecting burner flame and continuing said flow of gas to said burner as long as said burner flame exists;

closing one of said valves;

determining if said burner flame still exists and providing an indication of valve leakage if said burner flame still exists;

closing the other of said valves; and reversing order of closing said valves on alternate burner cycles.

2. The method claimed in claim 1 wherein said step of energizing the igniter includes the step of measuring voltage representative of voltage across said igniter for determining that said voltage across said igniter is sufficient to enable said igniter to attain gas ignition temperature, and the step of continuing energizing of said igniter to attain gas ignition temperature, and wherein said step of detecting burner flame and continuing said flow of gas to said burner as long as said burner flame exists includes the step of measuring voltages representative of flame gap impedance and effecting continued flow of gas to said burner when said measured voltages are indicative of existence of burner flame.

3. The method claimed in claim 2 wherein said step of continuing energizing of said igniter includes modulating said energizing of said igniter so as to prevent unnecesary heating thereof.

4. An improved method for operating a direct ignition gas burner control system which includes a thermostat, a burner, two electrically operated valves connected fluidically in series with the burner, an electrical resistance igniter, and a microcomputer, comprising the steps of:

minitoring the thermostat to determine when said thermostat is calling for heat;

setting a delay timer time period upon a call for heat;

energizing the igniter upon timing out of said delay timer time period;

measuring voltage representative of voltage across said igniter for determining that said voltage across said igniter is sufficient to enable said igniter to attain gas ignition temperature;

continuing energizing of said igniter to attain gas ignition temperature;

detecting and storing in a memory of said microcomputer a first voltage value representative of flame gap impedance in absence of a burner flame;

opening the two valves;

setting a trial ignition time period during which gas flows to said burner and said igniter is maintained energized;

detecting a second voltage value representative of flame gap impedance in presence of gas flow to said burner;

comparing said first and second voltage values representative of flame gap impedance and replacing said first voltage value with said second voltage value in said memory if said comparison thereof is indicative of existence of said burner flame;

detecting, during the remainder of said trial ignition time period, subsequent voltage values representative of flame gap impedance, if said comparison of said first and second voltage values is not indicative of said existence of said burner flame, until comparison of one of said subsequent voltages values with said first voltage value is indicative of said existence of said burner flame, and replacing said first voltage value with said one of said subsequent voltage values in said memory when said comparison thereof is indicative of said existence of said burner flame;

de-energizing said igniter when said comparison of said first voltage value with said second or said one of said subsequent voltage values is indicative of said existence of said burner flame;

continuing detecting voltage values representative of flame gap impedance, comparing successive voltage values, and replacing a previously stored voltage value in said memory when said comparison thereof is indicative of existence of said burner flame, so as to effect continued flow of gas to said burner as long as said burner flame exists; and closing said valves when said thermostat is satisfied, said step of closing said valves being a sequential closing, and said sequential closing comprising the steps of closing one of said valves, determining if said burner flame exists and providing an indication of valve leakage if said burner flame exists, closing the other of said valves, and reversing order of closing said valves on alternate burner cycles.

* * * * *